US007363910B2

(12) United States Patent
Schieber et al.

(10) Patent No.: US 7,363,910 B2
(45) Date of Patent: Apr. 29, 2008

(54) IGNITION CIRCUIT HAVING A HIGH-ENERGY SPARK FOR AN INTERNAL COMBUSTION ENGINE

(75) Inventors: Eberhard Schieber, Backnang (DE); Heinrich Leufen, Schwaikheim (DE); Mohamed Abou-Aly, Waiblingen (DE); Hans Nickel, Weissach (DE); Heiko Rosskamp, Adelberg (DE); Jörg Schlossarczyk, Winnenden (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 11/494,501

(22) Filed: Jul. 28, 2006

(65) Prior Publication Data

US 2007/0034190 A1 Feb. 15, 2007

(30) Foreign Application Priority Data

Aug. 12, 2005 (DE) ..... 10 2005 038 198

(51) Int. Cl.
*F02P 3/08* (2006.01)

(52) U.S. Cl. ..... 123/406.24; 123/406.57; 123/599

(58) Field of Classification Search ..... 123/335, 123/406.24, 406.57, 599, 339.11
See application file for complete search history.

(56) References Cited

U.S. PATENT DOCUMENTS

| | | | | |
|---|---|---|---|---|
| 4,150,652 | A * | 4/1979 | Nagasawa | 123/406.57 |
| 4,297,977 | A * | 11/1981 | Boyama | 123/335 |
| 5,433,184 | A * | 7/1995 | Kinoshita et al. | 123/406.57 |
| 6,662,792 | B2 * | 12/2003 | Dutt et al. | 123/599 |
| 7,000,595 | B2 * | 2/2006 | Andersson et al. | 123/406.57 |

* cited by examiner

*Primary Examiner*—T. M. Argenbright
(74) *Attorney, Agent, or Firm*—Walter Ottesen

(57) ABSTRACT

An ignition circuit is for an internal combustion engine in a handheld portable work apparatus. A combustion chamber (4) is configured in the cylinder (3) of the engine (1) which is delimited by a piston (5) driving a crankshaft (7). A pole wheel (10) revolves with the crankshaft (7) and is assigned to an induction loop (13). The pole wheel periodically changes the magnetic flux in the induction loop. An ignition capacitor (16) is charged by a charge coil (14) of the induction loop and is discharged via a discharge circuit (15) via an ignition coil (17). The ignition coil is connected to a spark plug (19) projecting into the combustion chamber. For achieving a powerful ignition spark, the discharge of the ignition capacitor is prevented by an rpm evaluation circuit (23) when the rpm curve (30) exhibits an rpm change (Δn) which exceeds a pregiven threshold value.

16 Claims, 3 Drawing Sheets

IGNITION CIRCUIT HAVING A HIGH-ENERGY SPARK FOR AN INTERNAL COMBUSTION ENGINE

CROSS REFERENCE TO RELATED APPLICATION

This application claims priority of German patent application no. 10 2005 038 198.7, filed Aug. 12, 2005, the entire content of which is incorporated herein by reference.

FIELD OF THE INVENTION

An ignition circuit is provided for an internal combustion engine and especially for an internal combustion engine in a handheld portable work apparatus. A combustion chamber is configured in the cylinder of the engine which is delimited by a piston driving a crankshaft. An electromagnetic induction loop and a pole wheel are provided. The pole wheel revolves with the crankshaft and is assigned to the induction loop. The pole wheel periodically changes the magnetic flux in the induction loop. An ignition capacitor is charge by a charged coil of the induction loop and is discharged via a discharge circuit via an ignition coil. The ignition coil is connected to a spark plug projecting into the combustion chamber.

BACKGROUND OF THE INVENTION

Ignition circuits of the above kind are also known as capacitor ignition circuits and are generally known. These ignition circuits have a robust simple configuration and have been proven many times in practice.

In two-stoke engines, irregular combustions occur during idle operation of the engine. Thus, it has been determined that a complete combustion with corresponding rpm increase occurs, for example, only every third crankshaft revolution during idle operation of the two-stroke engine. In individual cases, combustions were only observed after the sixth or seventh crankshaft revolution.

SUMMARY OF THE INVENTION

It is an object of the invention to improve the combustion in the combustion chamber of a cylinder of an internal combustion engine especially during idle and to ensue a reliable ignition of the mixture.

The ignition circuit of the invention is for an internal combustion engine. The engine includes a cylinder, a piston disposed in the cylinder to move upwardly and downwardly therein during operation of the engine, a combustion chamber formed in the cylinder and delimited by the piston, a crankcase connected to the cylinder and a crankshaft supported in the crankcase driven in rotation by the piston. The ignition circuit includes: an electromagnetic induction loop conducting magnetic flux and including a charging coil in which voltage is induced; a pole wheel operatively connected to the induction loop and revolving with the crankshaft to periodically charge the magnetic flux in the induction loop in dependence upon the position of the crankshaft; an electronic control circuit including a capacitor connected to the charging coil to be charged by the voltage induced in the charging coil; a spark plug mounted in the cylinder so as to project into the combustion chamber; an ignition coil connected to the spark plug to ignite a mixture present in the combustion chamber; the electronic control circuit further including a discharge circuit for discharging the capacitor via the ignition coil at predetermined positions of the crankshaft; and, an rpm evaluation circuit for monitoring the discharge circuit and intervening therein to perform an override function when an rpm change ($\Delta n$) in the rpm curve deviates from a pregiven threshold value.

According to the basic idea of the invention, the ignition capacitor is not charged only over one crankshaft revolution but over several crankshaft revolutions. In the ignition capacitor (without a large change of the ignition circuit), a higher amount of energy can be stored and, when this energy is discharged via the ignition coil, a strong, long-burning ignition spark can be achieved. A strong preferably long-burning ignition spark offers the certainty of a good combustion whereby the combustion sequence can be made more regular in the idle operation.

In one embodiment of the invention, the discharge circuit is monitored by an rpm evaluation circuit which intervenes in the discharge circuit when the rpm curve exhibits an rpm change which deviates from a pregiven threshold value, for example, when there is a drop below the threshold value or the threshold value is exceeded.

In a two-stoke engine, the rpm increase after a successful combustion is detected with the rpm evaluation circuit in order to then (after determining the rpm increase) prevent a discharge of the capacitor, that is, an ignition spark for the next crankshaft revolution. The voltage of the second crankshaft revolution, which is induced in the charge coil, can be used to further charge the capacitor so that, in a subsequent crankshaft revolution, a discharge of the capacitor leads to a strong, preferably long-burning ignition spark which offers the assurance for a reliable combustion. In this way, a more regular combustion takes place in the idle case so that the idle rpm is more stable.

The invention is easily applicable also to a four-stroke engine. In a four-stoke engine, the curve of the rpm plotted as a function of crankshaft angle exhibits a significant rpm drop during the upward stroke of the piston for compressing the mixture. This rpm drop is an indicator that an ignition must take place when reaching top dead center (TDC) because a compressed mixture is present in the combustion chamber. The rpm evaluation circuit will therefore immediately activate the discharge circuit when there is an rpm change exceeding a pregiven threshold value so that an ignition takes place directly at the following TDC. After the ignition, the rpm evaluation circuit inhibits the discharge circuit in order to prevent the ignition capacitor to discharge during the following crankshaft revolution. In a four-stroke engine, the crankshaft revolution, which follows the combustion, is for discharging the exhaust gases out of the open discharge and, for this reason, an ignition spark is not needed. The evaluation circuit suppresses the ignition spark and thereby prevents a discharge of the ignition capacitor so that only with the following upward stroke the discharge circuit is again enabled in order to ignite anew in the third crankshaft revolution.

According to another solution of the object of the invention, the ignition spark is subdivided into sequential component ignition sparks to improve the combustion in the combustion chamber of an internal combustion engine. With this method, the certainty of an ignition is increased. If, for example, a first component ignition spark does not lead to a combustion, then the probability of a combustion with a second component ignition spark is increased. If energy is available, also additional follow-on third, fourth, et cetera, component ignition sparks can be triggered. It is practical that the distance of the component ignition sparks lies in a range of 0° KW to 30° KW, preferably approximately 3°

KW to 10° KW. If the distance is selected to be zero or almost zero, the component ignition sparks together form an individual ignition spark with a longer burning duration. It can also be practical when the combustion durations of the ignition sparks overlap.

The needed energy for making available two or more ignition sparks can, for example, be made available by suppressing the ignition after a combustion. It is also practical to configure the pole wheel with two or more magnets so that, per revolution, a voltage is induced a number of times which is stored in a suitable store, for example, a capacitor.

To generate the component ignition sparks, a common capacitor can be discharged in individual component discharges, Each component discharge triggers a component ignition spark. It can also be practical to assign a capacitor to each component ignition spark and to discharge the so-provided capacitors offset in time via a common ignition coil.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
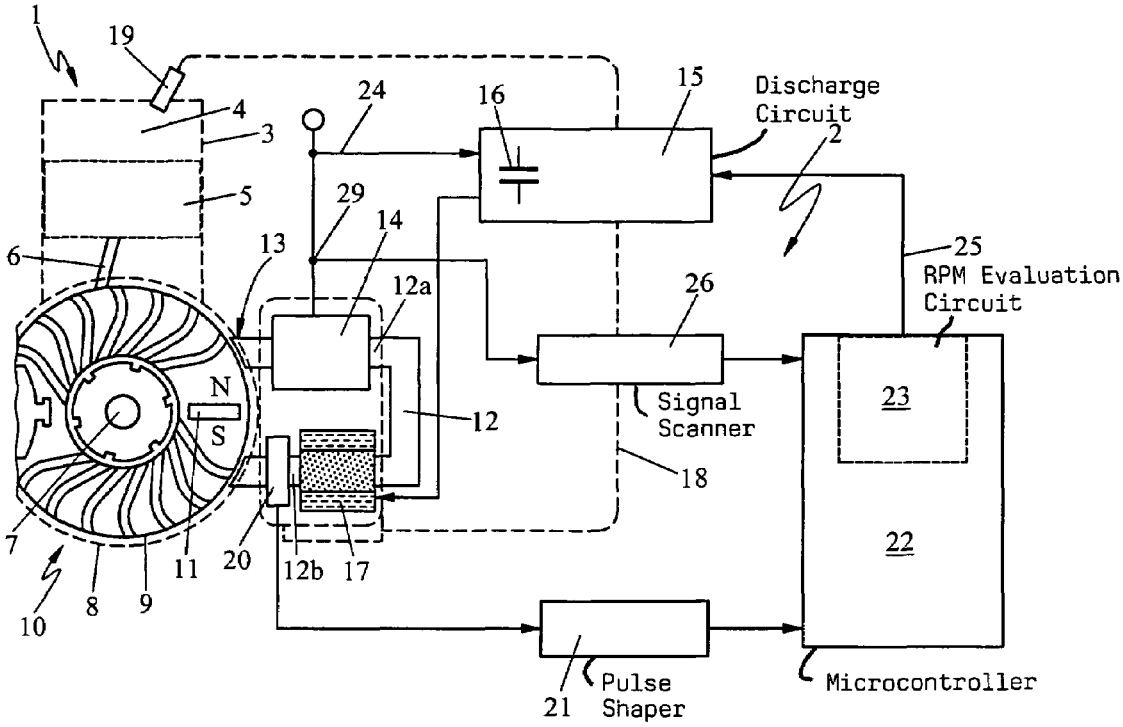
FIG. 1 is a schematic of an internal combustion engine shown with an ignition circuit assigned thereto.

In FIG. 1, an internal combustion engine 1 is shown with an ignition circuit 2 assigned thereto. The engine 1 has a conventional configuration and serves especially as a drive motor in a hand-guided work apparatus, especially, in a portable handheld work apparatus such as a motor-driven chain saw, cutoff machine, brushcutter, blower apparatus or the like.

The engine 1 includes a cylinder 3 and a combustion chamber 4 formed in the cylinder 3. The combustion chamber 4 is delimited by the up and down moving piston 5. The piston 5 is connected to a crankshaft 7 via a connecting rod 6 and the crankshaft 7 is journalled in the crankcase 8. The piston 5 drives the crankshaft 7 in rotation and a pole wheel 10 revolves with the crankshaft 7. In the embodiment shown, the pole wheel 10 is configured as a fan wheel 9. A pole shoe having a magnet 11 is mounted in the pole wheel 10 and the magnet has poles (N, S) which lie aligned in the peripheral direction of the fan wheel 9.

A stationary yoke 12 on the motor housing is assigned to the rotating pole wheel 10. The yoke 12 together with the pole shoe in the pole wheel 10 is configured as an induction loop 13.

In the embodiment shown, a charge coil 14 is arranged on a leg 12*a* of the yoke 12. This charge coil 14 is electrically connected to a capacitor 16 arranged in a discharge circuit 15. The capacitor 16 is discharged by the discharge circuit 15 via a primary winding of an ignition coil 17 and the secondary winding is connected to a spark plug 19 via an ignition cable 18. A mixture present in the combustion charmer 4 is ignited via the spark plug 19.

The rpm of the crankshaft 7 can be tapped via a trigger coil 20 which is mounted on the other yoke leg 12*b*. The signal of the trigger coil 20 is supplied via a pulse shaper 21 to a microcontroller 22 which, inter alia, contains an rpm evaluation circuit 23. The rpm evaluation circuit 23 controls the discharge circuit 15 so that the discharge circuit 15 is driven or not driven in dependence upon the rpm evaluation circuit 23.

Figure 2:
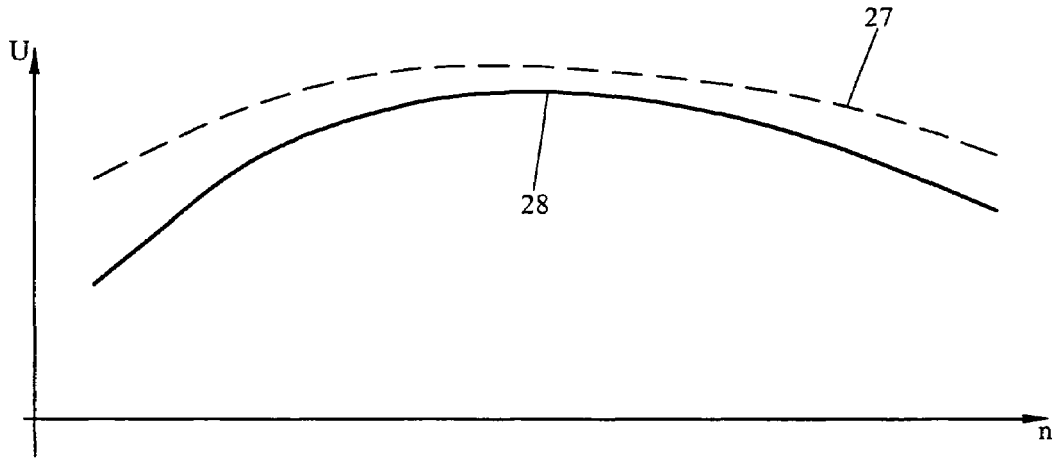
FIG. 2 is a graph showing the capacitor voltage plotted as a function of rpm.

The yoke 12 is closed via the pole shoe with each revolution of the fan wheel 9 (pole wheel 10) whereby, in the yoke 12, a magnetic flux periodically builds up and decays in the induction loop 13 which induces an induction voltage in the charge coil 14 and the trigger coil 20. The induction voltage of the charge coil 14 is supplied via the conductor branch 24 of the discharge circuit 15 for feeding the capacitor 16 which, as shown in FIG. 2, charges to a voltage U in dependence upon the rpm n. The energy $$E = \frac{1}{2}CU^2,$$

which is stored in the capacitor, is outputted by the discharge circuit 15 to the primary winding of the ignition coil 17 in dependence upon a control signal on the control line 25 of the microcontroller 22 whereby a high voltage pulse results in the secondary coil with the discharge operation of the capacitor 16. The high voltage pulse is supplied via the ignition cable 18 to the spark plug 19 and there triggers an ignition spark for igniting the mixture in the combustion chamber 4.

The time point, at which the ignition Z is triggered, is determined by the microcontroller 22 which receives an rpm datum via the trigger coil 20 and processes the same.

Alternatively, the rpm signal can also be tapped at the signal output 29 of the charge coil 14 and, for this purpose, the output of the charge coil 14 is to be connected to the microcontroller 22 via a signal scanner 26.

Figure 3:
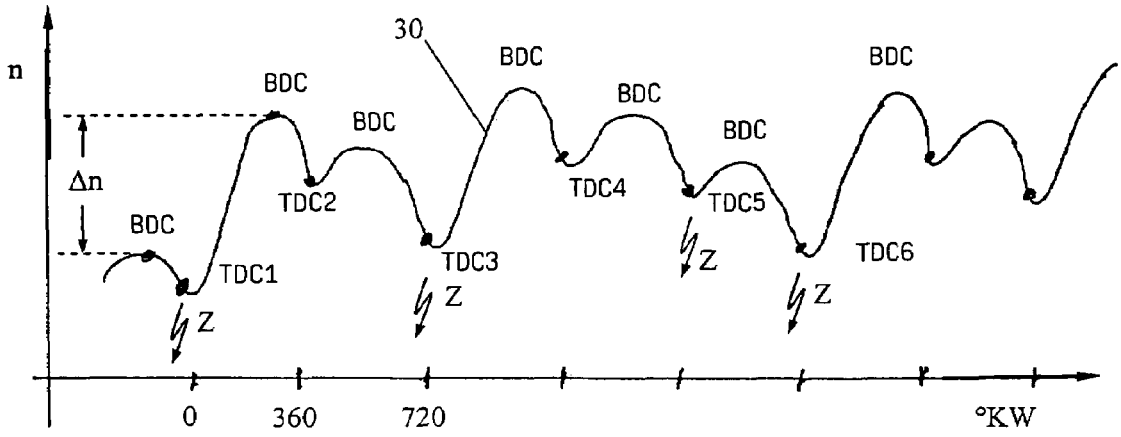
FIG. 3 is a curve showing rpm plotted as a function of several crankshaft revolutions of a two-stroke engine.

FIG. 3 shows the course of an rpm n plotted as a function of crankshaft angle ° KW. The rpm curve 30 fluctuates greatly. This intense fluctuating rpm curve 30 is typical for a two-stroke engine, especially at idle, because, in idle, a combustion in the combustion chamber 4 cannot be initiated with each crankshaft revolution.

If an ignition Z takes place in the region of top dead center (TDC), the rpm n increases greatly to bottom dead center (BDC) which can be easily detected by the rpm evaluation circuit 23 of the microcontroller 22. This rpm increase Δn can lie in a range of, for example, 600 to 800 rpm.

After running through the bottom dead center (BDC), the compression work takes place for a next combustion stroke and, according to the invention, the ignition Z is suppressed when reaching TDC2. After running through top dead center (TDC2), a slight rpm increase takes place because of the compression work in order to again drop off to the next top dead center point TDC3.

According to the invention, the rpm evaluation circuit 23 monitors the rpm increase Δn and when the rpm increase exceeds a threshold value of, for example, 500 rpm, the discharge circuit 15 inhibits for the following crankshaft revolution. This means that in the region TDC2, an ignition and therefore a discharge of the capacitor 16 is prevented so that the capacitor 16 is further charged because of the renewed induction voltage in the charge coil 14 as shown in FIG. 2 by the broken line 27. The solid line 28 indicates the capacitor voltage U after the particular charging as a function of crankshaft revolution (n). The capacitor 16 has stored energy over two crankshaft revolutions according to line 27 which is used when reaching the following top dead center point TDC3 in order to generate a strong long-burning ignition spark at the spark plug 19. In this way, the best conditions for a combustion in the combustion chamber 4 are given and an ignition of the mixture can be reliably expected in the third crankshaft revolution. The storage of ignition energy over two crankshaft revolutions ensures a strong long-burning ignition spark which is a good guarantee for a combustion to take place in the combustion chamber 4.

It can be practical to so design the rpm evaluation circuit 23 that each two revolutions of the pole wheel 10 can be used to charge the capacitor 16 so that an ignition takes place only in the first, third, fifth, seventh, 2N−1th (N=1, 2, 3, 4, . . . ) crankshaft revolutions. It can also be practical to configure the number of crankshaft revolutions irregularly for which revolutions a discharge of the capacitor 16 is suppressed or to use two or several crankshaft revolutions for charging the capacitor 16. The case can also occur that (as shown at TDC5) an ignition spark Z is indeed generated but nonetheless no combustion takes place and therefore an increase in rpm does not occur. In an operating state of this kind, ignition occurs anew in the following crankshaft revolution at TDC6 in order to trigger a combustion. Only after a then occurring increase in rpm, does the rpm evaluation circuit 23 again inhibit the discharge circuit for, for example, a following crankshaft revolution so that the capacitor 16 is again charged to a higher voltage U.

Preferably, the microcontroller 22 ensures that the rpm evaluation circuit 23 only suppresses an ignition and prevents a discharge of the capacitor 16 when the engine is in the idle mode. It is practical when the above takes place via a monitoring of the rpm. If the rpm of the engine lies below a pregiven operating rpm, the rpm monitoring circuit 23 prevents a discharge of the capacitor 16 for one or several crankshaft revolutions as described. Preferably, the rpm monitoring circuit 23 is active in an rpm range of 2000 to 2500 revolutions per minute.

Figure 4:
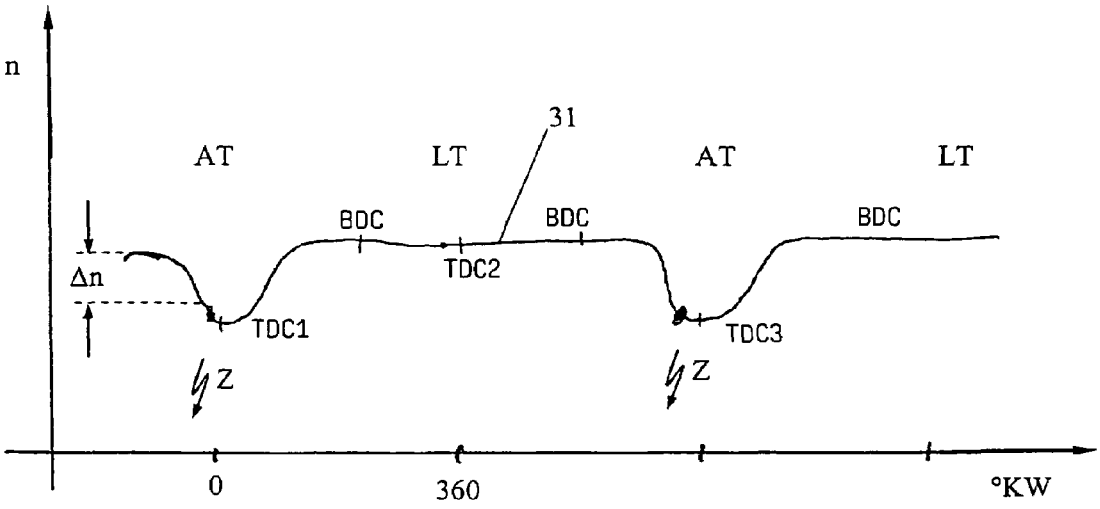
FIG. 4 is a plot of the rpm of a four-stroke engine as a function of several crankshaft revolutions.

The control of the discharge circuit 15 by an rpm evaluation circuit 23 in accordance with the invention is not only applicable for two-stroke engines but also, for example, for four-stroke engines. The course of the rpm of a four-stroke engine is shown in FIG. 4. A four-stroke engine of this kind has a more regular rpm curve 31 plotted as a function of crankshaft angle ° KW. A clear rpm drop Δn can be seen during the compression of the mixture in the work stroke AT. The rpm drop is again compensated after the ignition Z at top dead center (TDC1) via the combustion which takes place so that the idle rpm is essentially again present in the region of BDC. Running through the following top dead center point (TDC2) takes place during an idle stroke LT and has no material influence on the rpm because the discharge is open and no compression work takes place. Only after reaching the next top dead center (TDC3) is there compression work to be done again which again leads to a corresponding rpm drop Δn.

The rpm evaluation circuit 23 is a four-stoke engine is so designed that the compression stoke is detected when recognizing the rpm drop Δn of, for example, 200 revolutions per minute in order to then immediately enable the discharge circuit via the control line 25. The discharge circuit then discharges the capacitor 16 via the ignition coil 17 in the region of the following top dead center point TDC1 or TDC3 whereby an ignition spark Z is generated at the spark plug 19. In a four-stroke engine, the threshold value of the rpm change Δn lies clearly lower than for a two-stroke engine. In a four-stroke engine, an rpm change of, for example, Δn=200 revolutions per minute is significant for a work stroke at the end of which an ignition immediately takes place. In a four-stroke engine, the rpm evaluation circuit 23 can be provided over the entire operating range because, for an open discharge, the ignition spark Z can be regularly suppressed, that is, a discharge of the capacitor 16 can be prevented. In a four-stroke engine, an ignition can take place at TDC1, TDC3, TDC5, et cetera, over the entire rpm range.

Figure 5:
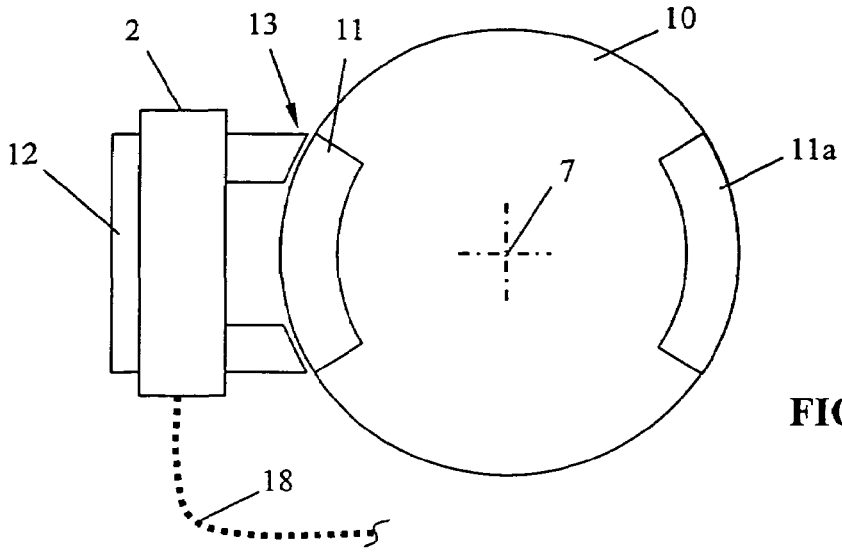
FIG. 5 is a schematic of an ignition arrangement having a pole wheel and two magnets.

In the embodiment of FIG. 5, a pole wheel 10 is shown with two magnets 11 and 11*a* which lie diametrically opposite each other and revolve with the crankshaft 7. In the coils of the yoke 12, a voltage is induced twice for each revolution and this voltage can be used to charge the capacitor 16 (FIG. 1). With the arrangement of FIG. 5, a strong ignition spark can be made available at the spark plug 19 also in the part load or full load range of the internal combustion engine without it being necessary to suppress an ignition.

Figure 7:
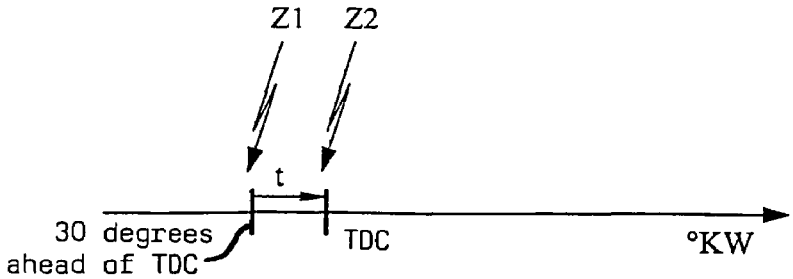

Advantageously, the ignition circuit 2 is so designed that two component ignition sparks (Z1, Z2) (FIG. 7) are generated for an ignition of the mixture in the combustion chamber 4 of the internal combustion engine 1. The component ignition sparks (Z1, Z2) preferably follow each other sequentially in time. The distance of the two component ignition functions can lie in the region between approximately 0° and 30° KW. A first component ignition spark Z1 (FIG. 7) is outputted, for example, 30° KW ahead of top dead center TDC of the piston 5 and a second component ignition spark Z2 ignites in the region of top dead center TDC of piston 5. In FIG. 7, the time-dependent distance t of the ignition sparks Z1 and Z2 is shown at 30° KW. The time-dependent distance t is correspondingly adapted to the operating conditions of the engine and its characteristic data. It can also be practical when the durations of combustion of the component ignition sparks Z1 and Z2 overlap each other.

For generating the component ignition sparks Z1 and Z2, a common capacitor 16 can be provided as shown in FIG. 1. This capacitor 16 is discharged via the ignition coil 17 in time sequential component discharges and, for this purpose, the discharge circuit 15 can be configured so as to be correspondingly adapted.

Figure 6:
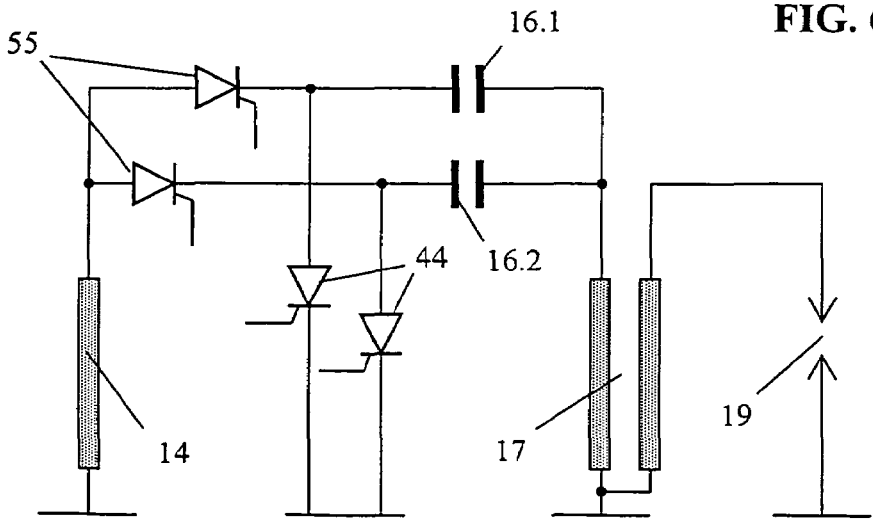
FIG. 6 is a schematic of an ignition circuit having two charging capacitors; and, FIG. 7 is a schematic of an ignition sequence plotted over the crankshaft angle.

Preferably, the ignition circuit is configured in accordance with the schematic circuit diagram in FIG. 6. The charge coil 14 charges two capacitors 16.1 and 16.2 which lie in parallel branches and are connected in common to the ignition coil 17. The two capacitors 16.1 and 16.2 are connected via control elements 55 to the charge coil 15 and can be discharged via the control element 44. It is practical when the control elements 44 and 55 are thyristors or like semiconductor elements which can be individually ignited independently of each other via separate control connections.

In this way, the discharge of the capacitor 16.1 can take place during a first crankshaft revolution via a conductive switching of the corresponding control element 55; whereas, during the second crankshaft revolution, the connection to the capacitor 16.1 is interrupted and the connection from the charge coil 14 to the capacitor 16.2 is conductively switched via the control element 55. If a pole wheel configuration is provided as shown in FIG. 5, the induced signal of the magnet 11 can be applied to the capacitor 16.1 and the second signal, which is induced by the magnet 11*a*, can be switched to the capacitor 16.2.

For triggering the ignition spark at the spark plug 19, the parallel branches of the capacitors 16.1 and 16.2 can be discharged individually or in common via the assigned control element 44 which leads to a corresponding component ignition spark (Z1, Z2) at the spark plug 19.

By this type of double ignition, not only a better combustion can be initiated, but furthermore also an ignition is ensured even under unfavorable conditions in the combustion chamber.

The method of the invention is not only applicable for two-stroke engines but also in other single or multi-cylinder engines, four-stroke engines or the like.

It is understood that the foregoing description is that of the preferred embodiments of the invention and that various changes and modifications may be made thereto without departing from the spirit and scope of the invention as defined in the appended claims.

What is claimed is:

1. An ignition circuit for a two-stroke internal combustion engine, the engine including a cylinder, a piston disposed in said cylinder to move upwardly and downwardly therein during operation of said engine, a combustion chamber formed in said cylinder and delimited by said piston, a crankcase connected to said cylinder and a crankshaft supported in said crankcase driven in rotation by said piston, the ignition circuit comprising:

an electromagnetic induction loop conducting magnetic flux and including a charging coil in which voltage is induced;

a pole wheel operatively connected to said induction loop and revolving with said crankshaft to periodically charge said magnetic flux in said induction loop in dependence upon the position of said crankshaft;

an electronic control circuit including a capacitor connected to said charging coil to be charged by the voltage induced in said charging coil;

a spark plug mounted in said cylinder so as to project into said combustion chamber;

an ignition coil connected to said spark plug to ignite a mixture present in said combustion chamber;

said electronic control circuit further including a discharge circuit for discharging said capacitor via said ignition coil at predetermined positions of said crankshaft;

an rpm evaluation circuit for monitoring said discharge circuit and intervening therein to perform an override function when an rpm change (Δn) in the rpm curve deviates from a pregiven threshold value; and, said rpm evaluation circuit inhibiting said discharge circuit for a next crankshaft revolution when said threshold value is exceeded in order to suppress a discharge of said capacitor and an ignition (Z).

2. An ignition circuit for a four-stroke internal combustion engine, the engine including a cylinder, a piston disposed in said cylinder to move upwardly and downwardly therein during operation of said engine, a combustion chamber formed in said cylinder and delimited by said piston, a crankcase connected to said cylinder and a crankshaft supported in said crankcase driven in rotation by said piston, the ignition circuit comprising:

an electromagnetic induction loop conducting magnetic flux and including a charging coil in which voltage is induced;

a pole wheel operatively connected to said induction loop and revolving with said crankshaft to periodically charge said magnetic flux in said induction loop in dependence upon the position of said crankshaft;

an electronic control circuit including a capacitor connected to said charging coil to be charged by the voltage induced in said charging coil;

a spark plug mounted in said cylinder so as to project into said combustion chamber;

an ignition coil connected to said spark plug to ignite a mixture present in said combustion chamber;

said electronic control circuit further including a discharge circuit for discharging said capacitor via said ignition coil at predetermined positions of said crankshaft;

an rpm evaluation circuit for monitoring said discharge circuit and intervening therein to perform an override function when an rpm change (Δn) in the rpm curve deviates from a pregiven threshold value; and, said rpm evaluation circuit inhibiting said discharge circuit to suppress an ignition and a discharge of said capacitor and, when said threshold value is exceeded, enabling said discharge circuit so that in the region of a following top dead center (TDC1), said capacitor is discharged and an ignition (Z) takes place.

3. An ignition circuit for an internal combustion engine, the engine including a cylinder, a piston disposed in said cylinder to move upwardly and downwardly therein during operation of said engine, a combustion chamber formed in said cylinder and delimited by said piston, a crankcase connected to said cylinder and a crankshaft supported in said crankcase driven in rotation by said piston, the ignition circuit comprising:

an electromagnetic induction loop conducting magnetic flux and including a charging coil in which voltage is induced;

a pole wheel operatively connected to said induction loop and revolving with said crankshaft to periodically charge said magnetic flux in said induction loop in dependence upon the position of said crankshaft;

an electronic control circuit including a capacitor connected to said charging coil to be charged by the voltage induced in said charging coil;

a spark plug mounted in said cylinder so as to project into said combustion chamber;

an ignition coil connected to said spark plug to ignite a mixture present in said combustion chamber;

said electronic control circuit further including a discharge circuit for discharging said capacitor via said ignition coil at predetermined positions of said crankshaft;

an rpm evaluation circuit for monitoring said discharge circuit and intervening therein to perform an override function when an rpm change (Δn) in the rpm curve deviates from a pregiven threshold value; and, said rpm evaluation circuit being active below a pregiven operating rpm.

4. The ignition circuit of claim 3, wherein said pregiven operation rpm lies in the region of the idle rpm.

5. The ignition circuit of claim 1, wherein said rpm evaluation circuit is defined by a microcontroller.

6. The ignition circuit of claim 1, wherein said ignition circuit further comprises a trigger coil in said electromagnetic induction loop; and, said rpm evaluation circuit elevates the signal of said trigger coil as an rpm signal.

7. The ignition circuit of claim 1, wherein said rpm evaluation circuit evaluates the signal of said charging coil as an rpm signal.

8. The ignition circuit of claim 1, wherein said internal combustion engine is in a handheld work apparatus.

9. The ignition circuit of claim 2, wherein said rpm evaluation circuit is defined by a microcontroller.

10. The ignition circuit of claim 2, wherein said ignition circuit further comprises a trigger coil in said electromagnetic induction loop; and, said rpm evaluation circuit evaluates the signal of said trigger coil as an rpm signal.

11. The ignition circuit of claim 2, wherein said rpm evaluation circuit evaluates the signal of said charging coil as an rpm signal.

12. The ignition circuit of claim 2, wherein said internal combustion engine is in a handheld work apparatus.

13. The ignition circuit of claim 3, wherein said rpm evaluation circuit is defined by a microcontroller.

14. The ignition circuit of claim 3, wherein said ignition circuit further comprises a trigger coil in said electromagnetic induction loop; and, said rpm evaluation circuit evaluates the signal of said trigger coil as an rpm signal.

15. The ignition circuit of claim 3, wherein said rpm evaluation circuit evaluates the signal of said charging coil as an rpm signal.

16. The ignition circuit of claim 3, wherein said internal combustion engine is in a handheld work apparatus.

* * * * *

UNITED STATES PATENT AND TRADEMARK OFFICE

CERTIFICATE OF CORRECTION

PATENT NO. : 7,363,910 B2
APPLICATION NO. : 11/494501
DATED : April 29, 2008
INVENTOR(S) : Eberhard Schieber et al.

It is certified that error appears in the above-identified patent and that said Letters Patent is hereby corrected as shown below:

In column 1:
Line 22: delete “charge” and substitute -- charged -- therefor.
Line 23: delete “charged” and substitute -- charge -- therefor.
Line 34: delete “two-stoke” and substitute -- two-stroke -- therefor.
Line 46: delete “ensue” and substitute -- ensure -- therefor.

In column 2:
Line 22: delete “two-stoke” and substitute -- two-stroke -- therefor.
Line 35: delete “four-stoke” and substitute -- four-stroke -- therefor.

In column 3:
Line 15: delete “charges,” and substitute -- charges. -- therefor.

In column 4:
Line 5: delete “charmer” and substitute -- chamber -- therefor.

In column 5:
Line 64: delete “is a four-stoke” and substitute -- in a four-stroke -- therefor.
Line 65: delete “stoke” and substitute -- stroke -- therefor.

In column 8:
Line 58: delete “operation” and substitute -- operating -- therefor.
Line 64: delete “elevates” and substitute -- evaluates -- therefor.

Signed and Sealed this

Nineteenth Day of August, 2008

JON W. DUDAS
*Director of the United States Patent and Trademark Office*